US010373587B2

(12) United States Patent
Offredi et al.

(10) Patent No.: US 10,373,587 B2
(45) Date of Patent: Aug. 6, 2019

(54) DIGITAL DISPLAY

(71) Applicant: BAE SYSTEMS plc, London (GB)

(72) Inventors: Matthew Frank Offredi, Rochester (GB); Luke Severino Offredi, Rochester (GB); Ross McCullie, Rochester (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 15/558,908

(22) PCT Filed: Mar. 15, 2016

(86) PCT No.: PCT/GB2016/050700
§ 371 (c)(1),
(2) Date: Sep. 15, 2017

(87) PCT Pub. No.: WO2016/146991
PCT Pub. Date: Sep. 22, 2016

(65) Prior Publication Data

US 2018/0090101 A1 Mar. 29, 2018

(30) Foreign Application Priority Data

Mar. 18, 2015 (GB) ..... 1504540.4
Mar. 27, 2015 (EP) ..... 15275090

(51) Int. Cl.
*G09G 5/10* (2006.01)
*G09G 3/20* (2006.01)
*G09G 3/36* (2006.01)

(52) U.S. Cl.
CPC ..... *G09G 5/10* (2013.01); *G09G 3/2029* (2013.01); *G09G 3/3618* (2013.01);
(Continued)

(58) Field of Classification Search
None
See application file for complete search history.

(56) References Cited

U.S. PATENT DOCUMENTS 6,100,939 A * 8/2000 Kougami ..... G09G 3/2033 345/690
6,674,429 B1 1/2004 Correa et al.
(Continued)

FOREIGN PATENT DOCUMENTS

EP 0833299 A1 4/1998
EP 0978816 A1 2/2000
WO 2016146991 A1 9/2016

OTHER PUBLICATIONS

International Preliminary Report on Patentability received for Patent Application No. PCT/GB2016/050700, dated Sep. 28, 2017. 11 pages.

(Continued)

*Primary Examiner* — Kenneth B Lee, Jr.
(74) *Attorney, Agent, or Firm* — Finch & Maloney PLLC

(57) ABSTRACT

A method for controlling a digital display device of a head or helmet-mounted display system and a head or helmet-mounted digital display system implementing the method are provided with the aim of controlling the display device in such a way as to reduce the effect of dynamic false contouring on the quality of a displayed image. According to the method, received image data defining brightness levels according to a scheme of light pulse modulation based upon binary-weighted pulse durations are converted into a data defining a sequence of pulses of binary and non-binary weighted duration in which the highest value weighting represents a pulse of a duration less than half the total duration of illumination required during an image refresh period to achieve a pixel at the highest brightness level. In a further embodiment, the weighting of highest value represents a pulse of duration less than one quarter of the duration required for highest pixel brightness.

21 Claims, 3 Drawing Sheets

(52) U.S. Cl.
CPC . *G09G 2310/08* (2013.01); *G09G 2320/0233* (2013.01); *G09G 2320/0261* (2013.01); *G09G 2320/0266* (2013.01); *G09G 2320/064* (2013.01); *G09G 2320/0646* (2013.01); *G09G 2340/145* (2013.01); *G09G 2360/18* (2013.01)

(56) References Cited

U.S. PATENT DOCUMENTS

| | | | | |
|---|---|---|---|---|
| 2004/0070590 | A1* | 4/2004 | Lee ..... | G09G 3/2022 345/690 |
| 2005/0212729 | A1 | 9/2005 | Chung et al. | |
| 2009/0189921 | A1* | 7/2009 | Miyagawa ..... | G09G 3/2029 345/690 |
| 2014/0313245 | A1 | 10/2014 | Park et al. | |

OTHER PUBLICATIONS

International Search Report and Written Opinion received for Patent Application No. PCT/GB2016/050700, dated May 24, 2016. 15 pages.
GB Intellectual Property Office Search Report under Section 17(5) received for GB Patent Application No. 1504540.4 dated Sep. 14, 2015. 4 pages.
Extended European Search Report, pursuant to Rule 62 EPC, received for EP Patent Application No. 15275090.7 dated Jun. 15, 2016. 7 pages.

* cited by examiner

| Bit Plane Number | Nominal Weighting | Period (us) | Illumination Period (us) |
|---|---|---|---|
| Bit Plane 0 | 1 | 60.667 | 9.333 |
| Bit Plane 1 | 2 | 70.000 | 18.667 |
| Bit Plane 2 | 4 | 88.667 | 37.333 |
| Bit Plane 3 | 8 | 126.000 | 74.667 |
| Bit Plane 4 | 16 | 200.667 | 149.333 |
| Bit Plane 5 | 32 | 350.000 | 298.667 |
| Bit Plane 6 | 48 | 499.333 | 448.000 |
| Bit Plane 7 | 48 | 499.333 | 448.000 |
| Bit Plane 8 | 48 | 499.333 | 448.000 |
| Bit Plane 9 | 48 | 499.333 | 448.000 |

DIGITAL DISPLAY

This invention relates to digital displays. In particular, but not exclusively, this invention relates to a head or helmet-mountable digital display system and a method for configuring and operating a digital display device in a head or helmet-mounted display system in such a way as to reduce the incidence of an effect known as 'dynamic false contouring' in displayed images.

Dynamic false contouring arises when there is rapid relative movement of the eye of a viewer and the surface of a digitally controlled image display panel or across a surface onto which a digitally generated image is being projected. In the context of a head or helmet-mounted display device, a person of ordinary skill in that field will be familiar with the different ways in which relative movement of the eye and displayed image artefacts may arise with the different types of image artefact known to be displayed in such display systems. Relative movement can have the effect that the eye sees light intended to form part of one pixel being falsely added to or subtracted from the light of an adjacent pixel, in the worst case causing a bright flash or sparkling effect to be seen. Known types of digital display device with which this effect can arise include Digital Micro-mirror Devices (DMD) and display devices based upon liquid crystal display (LCD) technologies, including Liquid Crystal on Silicon (LCOS) devices for example.

In a known method of operating a digital display device, each of the pixels in an image to be viewed is generated using a pulse modulation technique whereby the perceived brightness and colour of a pixel is determined by the total amount of light of a given wavelength that is emitted by the display device in respect of that pixel during an 'image refresh period'. The image refresh period is selected to be shorter than the minimum response period of the human eye to discrete changes to brightness or colour. An image refresh period in the range 16 to 20 ms is typical. Using the pulse modulation technique, a pixel of a required brightness is generated by causing the display device to emit a predetermined combination of light pulses of equal brightness but of differing duration which, if all emitted within the image refresh period, will be integrated by the eye so that a viewer perceives the pixel as having a uniform brightness over the image refresh period. Different colours are perceived by generating different combinations of red, green and blue light pulses of appropriate duration within the image refresh period, as is well known.

In such a method, dynamic false contouring arises from the perceived false addition and false subtraction of pulses intended for adjacent pixels. In the present invention a method of driving a digital display device has been devised with the intended advantage that the effect of dynamic false contouring on perceived image quality is reduced significantly.

In a first aspect, the present invention resides in a method for controlling a digital display device of a head or helmet-mounted display system to illuminate a pixel at any one of a plurality of brightness levels, wherein the display device is controllable to generate, for a given pixel and a selected one of said plurality of brightness levels, a predetermined sequence of light pulses within an image refresh period such that the pixel may be perceived as having said selected brightness level during the image refresh period, wherein the predetermined sequence of pulses comprises a predetermined combination of one or more pulses of relative duration selected according to a set of pulse weightings wherein the greatest weighting in the set of weightings represents a pulse duration of less than one half of the total duration of pixel illumination required within an image refresh period to achieve illumination of the pixel at the greatest of said plurality of brightness levels.

In the present invention, by limiting the duration of the longest pulse in a pulse modulation scheme for controlling the display device to less than half the duration required for maximum brightness (255 in an 8-bit scheme), the pulse of longest duration in conventional 8-bit schemes, representing a relative duration of 128 ($2^7$), is necessarily replaced by one or more pulses of shorter duration. The replacement pulses may be of binary-weighted duration, meaning a maximum duration defined by a power of 2, e.g. 64 or 32, or of non-binary weighted duration, e.g. a maximum duration represented by a weighting of 48 or 24 (out of a maximum 255), or a mixture of binary and non-binary weighted durations. The aim of the replacement set of pulse durations (weightings) is to provide for the same number of brightness levels as defined in received image data, but with the advantage that the light may be provided by pulses of shorter duration than in conventional display driving techniques so that the effect of a perceived false addition and false subtraction of the most heavily-weighted pulses is significantly reduced.

In one example embodiment, the set of pulse weightings comprises a plurality of binary weightings and one or more non-binary weightings. In particular, the set of pulse weightings may comprise a plurality of non-binary weightings.

In a further variant, the highest-value weighting included in the set of pulse weightings represents a pulse of duration no more than one quarter of the total duration of pixel illumination required within an image refresh period to achieve illumination of the pixel at the greatest of the plurality of brightness levels. In the 8-bit example, this ensures the replacement of the pulse of binary weighting 64 with pulses of lesser weighting (duration), further reducing the potential effect of a perceived false addition and false subtraction of pulses between pixels.

In a further example embodiment, the weighting of highest value included in the set of pulse weightings is a non-binary weighting and the set of pulse weightings includes two or more non-binary weightings of the same highest value. It is not therefore necessary for the set of allowed pulse durations all to be different and two or more pulses of the same longest duration may be used to illuminate a pixel in a given sequence of pulses.

In another example embodiment, each of the plurality of brightness levels is defined in received image data by a binary value representing a sequence of pulses each of binary-weighted duration and the method further comprises converting brightness levels defined in received image data into brightness levels defined according to respective sequences of light pulses having relative durations selected according to the set of pulse weightings.

In a further variant, each of the plurality of brightness levels is defined in received image data by a binary value representing a sequence of pulses each of binary-weighted relative duration and the method further comprises converting a received binary value into a binary value representing a predetermined sequence of light pulses of relative durations selected according to the set of pulse weightings, the method further comprising using the results of the conversion to control the digital display device.

In an example embodiment, the received image data comprise brightness levels represented by 8-bit binary values in the range 0 to 255, each representing a sequence of pulses of binary weighted relative durations selected from binary pulse weightings 1, 2, 4, 8, 16, 32, 64 and 128 and the method further comprises converting a brightness level defined by a received 8-bit binary value into a binary value representing a predetermined sequence of light pulses of relative durations selected according to the set of binary and non-binary pulse weightings 1, 2, 4, 8, 16, 32, 48, 48, 48 and 48 and controlling the digital display device to illuminate pixels using the predetermined sequence of light pulses resulting from the conversion. Optionally, the set of pulse weightings further comprises a non-binary weighting of 24 to provide more flexibility in selecting the sequence of pulses required to achieve a particular brightness level.

In a further example embodiment, the method further comprises generating and outputting a sequence of outputs for storage in an image buffer associated with the display device, each output comprising, for a pulse of a duration defined according to a weighting in the set of pulse weightings, indications of those pixels to be illuminated with the pulse of the defined duration. In a particular variant, the sequence of outputs represents pulses of higher weighting intermixed with pulses of lower weighting. It is not therefore necessary to trigger the display device to illuminate a pixel with pulses in the order of increasing pulse duration and the display device may instead be presented with data defining a different order of pulses while still achieving the same pixel brightness during an image refresh period.

In a second aspect, the present invention resides in a head or helmet-mountable digital display system, comprising:

a digital display device for displaying an image; and a display controller arranged to control the digital display device to display pixels in an image each at a required level of brightness, wherein the display controller comprises:

an input for receiving image data defining, for each of one or more pixels in an image to be displayed or updated, a brightness level selected from a predetermined plurality of brightness levels;

a processor arranged to receive image data from the input and to transform a brightness level indicated for a pixel in the received image data into a representation defining a predetermined combination of pulses of relative durations selected according to a predetermined set of pulse weightings wherein the highest-value weighting in the set of pulse weightings represents a pulse of duration less than one half of the total duration of pixel illumination required within an image refresh period to achieve illumination of the pixel at the greatest of the plurality of brightness levels and to generate a sequence of outputs for storage in an image buffer associated with the display device, each output comprising, for a pulse of a duration defined according to a weighting in the set of pulse weightings, indications of those pixels to be illuminated with the pulse of the defined duration; and means for controlling the display device to illuminate those pixels indicated by the contents of the image buffer.

In one example embodiment in this second aspect of the present invention, the predetermined set of pulse weightings comprises a plurality of binary weightings and one or more of non-binary weightings. Optionally, the predetermined set of pulse weightings comprises a plurality of non-binary weightings.

In another example embodiment of the system, the weighting of highest value in the set of pulse weightings represents a pulse of duration no more than one quarter of the total duration of pixel illumination required within an image refresh period to achieve illumination of the pixel at the greatest of the plurality of brightness levels.

In a further example embodiment of the system, the weighting of highest value in the set of pulse weightings is a non-binary weighting and the set of pulse weightings includes two or more non-binary weightings having the same highest value.

In another example embodiment of the system, each of the plurality of brightness levels is defined in received image data by a binary value representing a sequence of pulses each of binary-weighted duration and the processor is arranged to convert brightness levels defined in received image data into brightness levels defined according to respective sequences of light pulses having relative durations selected according to the set of pulse weightings.

In a further example embodiment of the system, each of the plurality of brightness levels is defined in received image data by a binary value representing a sequence of pulses each of binary-weighted relative duration and the processor is arranged to convert a received binary value into a binary value representing a predetermined sequence of light pulses of relative durations selected according to the set of pulse weightings and to use the results of the conversion to generate the sequence of outputs.

In a particular example embodiment of the system, the received image data comprise brightness levels represented by 8-bit binary values in the range 0 to 255, each representing a sequence of pulses of binary weighted relative durations selected from a set of binary pulse weightings 1, 2, 4, 8, 16, 32, 64 and 128 and the processor is arranged to convert a brightness level defined by a received 8-bit binary value into a binary value representing a predetermined sequence of light pulses of relative durations selected according to the set of binary and non-binary pulse weightings 1, 2, 4, 8, 16, 32, 48, 48, 48 and 48 and to use the results of the conversion to generate the sequence of outputs. Optionally, the set of pulse weightings further comprises a non-binary weighting of 24 to provide more flexibility in selecting the combination of pulses required to achieve a particular brightness level.

In a further example embodiment of the system, the sequence of outputs represent pulses of higher weighting intermixed with pulses of lower weighting.

In a third aspect, the present invention resides in a head or helmet-mountable display system having a digital display device incorporating or associated with a display controller arranged to implement the method according to the first aspect of the present invention or example embodiments thereof.

In a fourth aspect, the present invention resides in a head or helmet-mountable display system having a digital display device arranged to illuminate pixels with light pulses of relative duration defined by weightings selected in any predetermined combination from a set of binary weightings and non-binary-weightings.

In a particular example embodiment according to this fourth aspect of the present invention, the digital display device is arranged to illuminate pixels with light pulses of relative durations defined by weightings selected in any combination from the set of weightings 1, 2, 4, 8, 16, 32, 48, 48, 48, 48.

In a further particular variant according to this fourth aspect of the present invention, the digital display device is arranged to illuminate pixels with light pulses of relative durations defined by weightings selected in any combination from the set of weightings 1, 2, 4, 8, 16, 24, 32, 48, 48, 48, 48.

Embodiments of the present invention will now be described in more detail, by way of example only and with reference to the accompanying drawings, of which:

Figure 1:
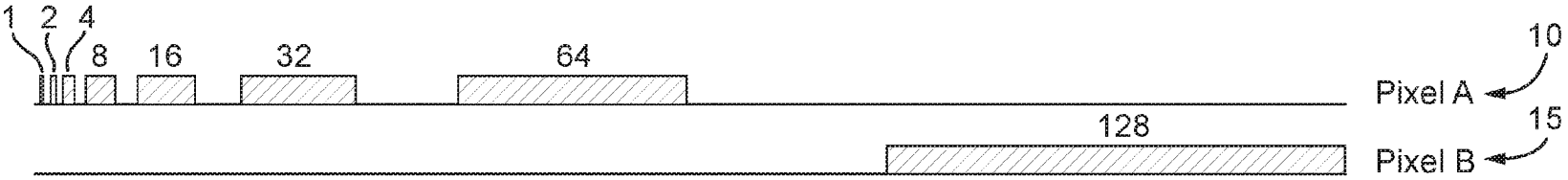
FIG. 1 shows an example sequence of light pulses in a known method for controlling a digital display device in a head or helmet-mountable display system for illuminating adjacent pixels in an image to be displayed.

In a typical application of a digital display device for a head or helmet-mounted display in which various symbols may be displayed overlain on an external scene, it may suffice to display monochrome pixels at any one of 256 different brightness levels from 0 ('off') to 255 (maximum brightness), each brightness level being defined using an 8 bit binary number. In conventional display devices, the 8-bit binary number for each pixel is interpreted, when controlling the display device, as a sequence of up to eight signals to trigger the display device to emit a corresponding sequence of pulses of light each of equal brightness but of a duration proportional to the value of the bit, from least significant bit value 1 ($2^0$) triggering the shortest pulse, representing 1/255 of the maximum pixel brightness, to the most significant bit value 128 ($2^7$) triggering the longest pulse, representing slightly more than half the maximum pixel brightness, the pixel being illuminated for a given pulse duration or not illuminated according to whether the respective bit is set to a '1' or a '0'.

If different colours are required, the 256 available brightness levels need to be applied separately to control different combinations of red, green and blue light sources to provide an overall colour brightness for each pixel for any of the different colours to be used to generate an image.

An image refresh period may be divided into what will be called 'sub-fields'. Each sub-field represents a period of time of a predetermined length—the sub-field 'weighting'—during which the display device may be triggered to emit or reflect a discrete pulse of light of duration proportional to the sub-field weighting for any pixel that requires it. The inherent latency of the display device will determine the shortest period of time that may be selected in respect of a sub-field. All weightings will be assumed to represent a proportion of the total duration of illumination required to display a pixel of maximum brightness (greatest brightness level) within the image refresh period. In the 8-bit example above, the image refresh period may be divided into eight differently-weighted sub-fields wherein the sub-field weightings are binary values 1, 2, 4, 8, 16, 32, 64, 128 representing different proportions of a maximum brightness value of 255 and hence of the total duration of illumination required to achieve a pixel of brightness 255. The data defining those pixels to be illuminated in a given sub-field are referred to as a 'brightness plane' or 'bit-plane' of data.

A bit-plane for a given sub-field contains a '1' or a '0' in respect of each pixel position in an image area of the display device requiring illumination with a light pulse of the respective duration or non-illumination in that sub-field. Each of the eight different bit-planes of data is uploaded to a display device memory according to the timing of the respective sub-field.

In this example, the first bit-plane defines those pixels to be illuminated for the shortest period, a weighting of 1, represented by the lowest significant bit of the 8-bit binary brightness value. The second bit-plane defines those pixels to be illuminated for a period represented by a weighting of 2; the third being for a period represented by a weighting of 4; and so-on until the eighth bit-plane defines those pixels to be illuminated for the longest period, represented by a weighting of 128. Within a short period of time of receiving a given bit-plane of data—this period being determined by the inherent latency in the display device—the display device illuminates all those pixels having a '1' in a respective position in the bit-plane of data.

One known problem with such a display driving technique is that of 'dynamic false contouring' whereby the eye is able to integrate one or more light pulses of one pixel with one or more light pulses intended for an adjacent or nearby pixel over an image refresh period due to rapid movement of the eye or at least rapid relative movement of the displayed image and the eye. Even though the changing illumination for a single pixel between sub-fields is not detectable by the eye, a sudden relative movement may cause the eye to perceive a given pixel as being brighter or less bright than intended. The effect is more pronounced when adjacent pixels are illuminated differently in respect of the most heavily-weighted sub-fields. An example of how this arises will now be described with reference to FIG. 1 and FIG. 2.

Referring firstly to FIG. 1, in the example of an 8-bit brightness level, pixels A and B are to be illuminated at levels 127 and 128 respectively of a possible 256 different brightness levels in the range of 0 ('off') to 255—the brightest. The brightness levels 127 and 128 should appear to the eye to be very similar over an image refresh period. FIG. 1 shows the intended series of light pulses to be displayed for each of pixel A and pixel B to achieve overall perceived brightness levels of 127 and 128 respectively. Pixel A (10) has been illuminated in each of the first seven sub-fields, corresponding to pulses of weightings 1, 2, 4, 8, 16, 32 and 64, to achieve an overall perceived brightness level of 127 over the image refresh period. Pixel B (15) has received no illumination in the first seven sub-fields and is to be illuminated in the eighth sub-field with a pulse of weighting 128 to achieve the required 128 brightness level over the image refresh period.

Figure 2:
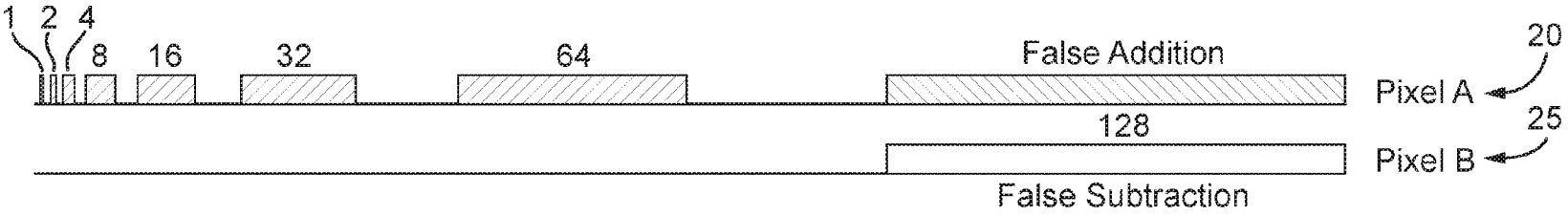
FIG. 2 shows how the effect of 'dynamic false contouring' may arise in using the light pulse sequence shown in FIG. 1.

However, referring to FIG. 2, a rapid relative movement of the eye and the displayed image causes the eye to perceive Pixel A (20) as having a 'false addition' of the 128-weighted pulse that illuminated Pixel B (25) and to perceive Pixel B (25) as having its 128-weighted pulse falsely subtracted. As a result, the eye perceives Pixel A (20) with an overall brightness level of 255 and Pixel B (25) with an overall brightness level of 0, instead of 127 and 128 respectively, creating a flash or sparkle in the vicinity of Pixel A. This is the worst case situation. However, the perception of false additions and subtractions between adjacent pixels may involve lower-weighted sub-fields which, though causing sparkling of reduced intensity is nevertheless capable of degrading the perceived quality of the image.

According to one example embodiment of the present invention, the number of sub-fields is increased for the purposes of driving the display device, which may for example be a micro-display device as supplied by Forth Dimension Displays Ltd, part number M249 SXGA. In the example of an 8-bit brightness level, this involves the introduction of a conversion step to transform an 8-bit representation of brightness in the image data to a 10-bit representation of brightness for the purposes of driving the display device. The present invention exploits the increased number of available sub-fields to generate a different set of available sub-field weightings (pulse durations) to that used in the conventional eight sub-field scheme described above. The chosen set of sub-field weightings has been selected to reduce the visual impact of false addition and substitution by reducing the maximum weighting (pulse duration) while increasing the number of the most heavily weighted sub-fields.

After careful consideration of a number of possible combinations of sub-field weighting, the inventors have found that a display driving scheme in which conventional binary-weighted subs-fields are combined with non-binary-weighted sub-fields. i.e. a weighting not equal to a power of 2, having a maximum weighting of no more than illumination level '48', as measured on the 8-bit illumination range 0-255, provides a good compromise between the effects of dynamic false contouring and a need to divide the image refresh period into a greater number of sub-fields than the display device is capable of supporting. Two example display driving schemes according to embodiments of the present invention, based upon sub-fields of maximum weight '48' and using 10 and 11 sub-fields, respectively, will now be described beginning with the 10 sub-field scheme and a reference to FIG. 3 and to FIG. 4.

Figure 3:
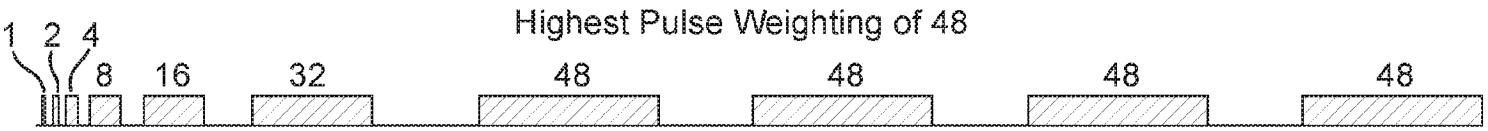
FIG. 3 shows an example of a light pulse sequence according to one embodiment of the present invention.
Figures 4, 5:
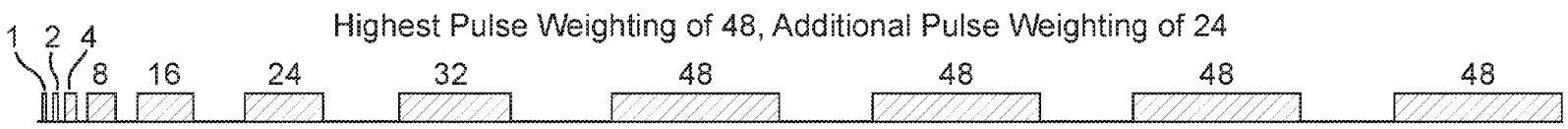
FIG. 4 is a table providing example timings and durations for the light pulse sequence shown in FIG. 3.
FIG. 5 shows an example of a light pulse sequence according to another embodiment of the present invention.

Referring to FIG. 3 and to FIG. 4, an improved pixel illumination scheme is presented: in FIG. 3 as a sequence of possible pixel illumination periods; and in FIG. 4 as a table of corresponding sub-field weightings, of respective sub-field time period and of actual illumination periods of light pulses to be emitted within the time period allocated to the sub-field. As can be seen, the '64' and '128' binary-weighted sub-fields of the conventional eight sub-field scheme have been replaced by four non-binary-weighted sub-fields of weight '48', giving a ten sub-field scheme. An additional conversion step is introduced into a typical display driver arrangement to receive conventional 8-bit pixel illumination level data and to convert those data, with reference to a look-up table, into a 10-bit illumination level for use in the display driver to provide the control bits for the ten sub-fields shown in FIG. 3 and FIG. 4. Digital display devices may be modified to receive ten bit-planes of data within an image refresh period and to illuminate pixels for any combination of the relative durations 1, 2, 4, 8, 16, 32, 48, 48, 48 and 48, providing for overall brightness levels in the range 0 to 255 as for the conventional scheme.

While, for example, an illumination level of 127 as represented by 01111111 in the conventional eight sub-field scheme may convert to any one of six different representations in such a scheme with non-binary sub-fields of weight '48', it may be desirable to illuminate the pixels as soon as possible during an image refresh period rather than adopting a delay as may be an option when a pixel needs to be illuminated during only one or two of the four available 48-weight sub-fields. Using, for example, a 10-bit binary number to represent the ten sub-field scheme, a brightness level of '127' may in principle convert to any one of:

0011011111
0101011111
1001011111
0110011111
1010011111 or
1100011111.

However, it has been found advantageous, but not essential, to complete the illumination of a pixel over as short a period as possible within the image refresh period, i.e. to group any required 48-weight sub-fields as closely as possible with the lower binary-weight sub-fields. Hence, in generating the look-up table for converting the input 8-bit image data into 10-bit display driver output, the first of those possible representations listed above for the brightness level 127 would be preferred. However, it may be advantageous when displaying certain types of image or in respect of particular regions of an image to adopt one of the alternative combinations of 48-weight sub-fields to achieve a given overall brightness where not all of the 48-weight sub-fields need to be filled It will also be apparent under this scheme that for brightness levels of between 48 and 63, the opportunity exists to use a 48-weight sub-field in combination with respective combinations of the lower binary-weight sub-fields. However, it is also preferred that the first use of a 48-weight sub-field be avoided as far as possible to make maximum use of the binary-weighted sub-fields and so reduce the opportunity for the false addition and subtraction of a 48-weight sub-field. By this principle, all brightness levels of between 1 and 63 may be achieved using the six binary-weighted sub-fields: 1, 2, 4, 8, 16 and 32.

A brightness level of 64 would then be represented by the 10-bit value 0001010000 and brightness levels of 64 to 111 would be represented using only the same seven sub-fields, even though brightness values of between 96 and 111 would have the option of using two of the 48-weight sub-fields.

The inventors have realised, further, that it may be advantageous to illuminate pixels using a particular bit-plane order, intermixing the most heavily-weighted sub-fields with the lowest-weight subfields. For example, in one embodiment based upon the ten sub-field scheme shown in FIG. 3 and FIG. 4, the bit-planes are uploaded to the display device and pixels illuminated in the order:

Bit Plane 9
Bit Plane 0
Bit Plane 8
Bit Plane 1
Bit Plane 7
Bit Plane 2
Bit Plane 6
Bit Plane 3
Bit Plane 5
Bit Plane 4.

When applying this sequence or any example sequence of bit-planes according to the present invention to the control of a digital display device it may be necessary to take account of certain characteristics of the display device technology both in ordering and in the timing of upload to the display device. For example, when applying the present invention to liquid crystal display (LCD) devices, e.g. liquid crystal on silicon (LCOS) display devices, the requirements of pixel 'charge balancing' need to be taken into account, as would be apparent to a person of ordinary skill in the field of digital display device technology.

Referring to FIG. 5, in the alternative eleven sub-field scheme mentioned above, according to another example embodiment of the present invention, an additional 24-weight sub-field is inserted between the 16 and 32-weight sub-fields to provide further options for using combinations of lower-weighted sub-fields to achieve a given overall level of pixel brightness. An 11-bit binary number may be used to represent this 11 sub-field scheme as would be apparent to a notional skilled person in this field, adopting the same principles as discussed above in generating a corresponding sequence of bit-planes for uploading to the display driver.

It will be apparent to a notional skilled person in the field that there are a great many alternative schemes that may be devised, based upon the same or a greater number of bit-planes and including combinations of sub-fields of binary-weight and non-binary-weight, and having a maximum weighting of less than would be used in a conventional scheme. It is generally the case that the lower the maximum weighting, the greater the required number of sub-fields and hence of bit-planes of data that need to be generated and handled by the display device in order to define a given number of luminance levels. All such combinations are intended to fall within the scope of the present invention.

In another example embodiment of the present invention a digital display system is provided to include an additional processing function arranged with access to a look-up table devised according to the principles above to convert a conventional representation of pixel brightness, e.g. using an 8-bit representation, into a display driver representation based upon 10 or 11 sub-fields and a 10 or 11-bit representation. This system will now be described with reference to FIG. 6.

Figure 6:
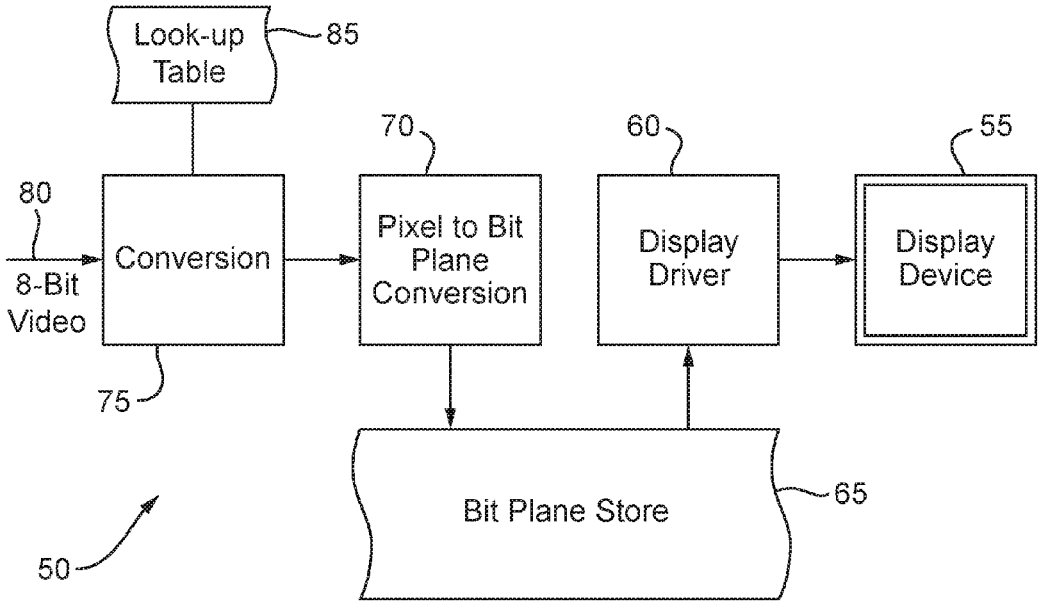
FIG. 6 is a simplified representation, in the form of a functional block diagram, of a digital display system according to an embodiment of the present invention.

Referring to FIG. 6, a functional block diagram is providing showing a simplified representation of a digital display system 50 in which the functionality described above may be implemented. A digital Display Device 55 is controlled by a Display Driver 60, arranged to control the illumination of pixels and in particular the timing and duration of illumination to be provided to each pixel in order to render components of an image to be displayed over a period of time corresponding to each sub-field of an image refresh period. The Display Driver 60 obtains the data to be used in controlling the Display Device 55 for a sub-field from a Bit-Plane Store 65. The bit-planes of data for each sub-field are uploaded to the Bit-Plane Store 65 by a Pixel-to-Bit-Plane Conversion module 70 which in turn receives as input image data that has been converted from input 8-bit video data 80 to a 10-bit representation defining a sub-field weighting scheme according to an embodiment of the present invention in a Conversion module 75. The Conversion module 75 performs the conversion with reference to the contents of a Look-up Table 85 which contains, for each of the 256 possible 8-bit values of received video data, a 10-bit representation resulting in the same brightness level but based upon the sequence of sub-field weightings for the 10 sub-field scheme described above. An equivalent conversion process may be implemented by the Conversion module 75 with reference to a corresponding Look-up Table 85 to achieve the conversion to an 11-bit representation based upon the eleven sub-field embodiment described above with reference to FIG. 5.

Example embodiments of the present invention described above have demonstrated the benefits of driving a digital display in such a way as to reduce the maximum weighting (light pulse duration) and at the same time increase the number of sub-fields in an image refresh period while retaining the capability to generate pixels of a required number of distinct pixel brightness levels. The present invention has also demonstrated the benefits in including non-binary-weighted light pulses in combination with binary-weighted light pulses to enable pulse combinations to be selected for driving the display device that reduce the visual impact of false additions and subtractions of pulses between pixels. Presented with the inventive principles described above, a notional skilled person in the relevant field would be able to select alternative weightings and combinations and to test their relative benefit in improving image quality. All such variations as would be apparent to the notional skilled person are intended to fall within the scope of the present invention.

The invention claimed is:

1. A method for controlling a digital display device of a head-mounted or helmet-mounted display system to illuminate a pixel at any one of a plurality of brightness levels, the method comprising:

controlling the digital display device to generate, for a given pixel and a selected one of said plurality of brightness levels, a predetermined sequence of light pulses within an image refresh period such that the pixel may be perceived as having said selected brightness level during the image refresh period, wherein the predetermined sequence of pulses comprises a predetermined combination of one or more pulses of relative duration defined by weightings selected from a set of a plurality of binary pulse weightings and a plurality of non-binary pulse weightings, wherein the non-binary pulse weightings are greater than the binary pulse weightings, wherein a highest-value weighting in the set of non-binary pulse weightings represents a pulse duration of less than one half of a total duration of pixel illumination required within an image refresh period to achieve illumination of the pixel at a greatest of said plurality of brightness levels, and wherein the predetermined sequence of pulses includes a sequence of pulses defined by alternately intermixed binary pulse weightings and non-binary pulse weightings.

2. The method according to claim 1, wherein the highest-value weighting in the plurality of non-binary pulse weightings represents a pulse of duration no more than one quarter of the total duration of pixel illumination required within an image refresh period to achieve illumination of the pixel at the greatest of said plurality of brightness levels.

3. The method according to claim 2, wherein the plurality of non-binary pulse weightings includes two or more non-binary pulse weightings of the same highest-value.

4. The method according to claim 1, wherein each of said plurality of brightness levels is defined in received image data by a binary value representing a sequence of pulses each of binary-weighted duration and the method further comprises converting brightness levels defined in received image data into brightness levels defined according to respective sequences of light pulses having relative durations defined by weightings selected from the set of the plurality of binary pulse weightings and the plurality of non-binary pulse weightings.

5. The method according to claim 4, wherein each of said plurality of brightness levels is defined in received image data by a binary value representing a sequence of pulses each of binary-weighted relative duration and the method further comprises converting a received binary value into a binary value representing a predetermined sequence of light pulses of relative durations defined by weightings selected from the set of the plurality of binary pulse weightings and the plurality of non-binary pulse weightings, the method further comprising controlling the digital display device using the results of the conversion of the received binary value into a binary value representing a predetermined sequence of light pulses of relative durations.

6. The method according to claim 5, wherein the received image data comprise brightness levels represented by 8-bit binary values in the range 0 to 255, each representing a sequence of pulses of binary weighted relative durations selected from binary pulse weightings 1, 2, 4, 8, 16, 32, 64 and 128 and the method further comprises:

converting a brightness level defined by a received 8-bit binary value into a binary value representing a predetermined sequence of light pulses of relative durations defined by weightings selected from the set of the plurality of binary pulse weightings and the plurality of non-binary pulse weightings 1, 2, 4, 8, 16, 32, 48, 48, 48 and 48; and controlling the digital display device to illuminate pixels using said predetermined sequence of light pulses resulting from the conversion of the brightness level defined by a received 8-bit binary value into a binary value.

7. The method according to claim 6, wherein the set of the plurality of binary pulse weightings and the plurality of non-binary pulse weightings further comprises a non-binary pulse weighting of 24.

8. The method according to claim 1, further comprising generating and outputting a sequence of outputs for storage in an image buffer associated with the digital display device, each output comprising, for a pulse of a duration defined according to a weighting in the set of the plurality of binary pulse weightings and the plurality of non-binary pulse weightings, indications of those pixels to be illuminated with the pulse of said defined duration.

9. The method according to claim 8, wherein said sequence of outputs represents pulses of higher weighting intermixed with pulses of lower weighting.

10. A head-mountable or helmet-mountable digital display system, comprising:

a digital display device for displaying an image; and a display controller arranged to control the digital display device to display pixels in an image each at a required level of brightness, wherein the display controller comprises:

an input for receiving image data defining, for each of one or more pixels in an image to be displayed or updated, a brightness level selected from a predetermined plurality of brightness levels;

a processor arranged to receive image data from the input and to transform a brightness level indicated for a pixel in the received image data into a representation defining a predetermined sequence of pulses of relative durations defined by weightings selected from a predetermined set of a plurality of binary pulse weightings and a plurality of non-binary pulse weightings, wherein the plurality of non-binary pulse weightings are greater than the plurality of binary pulse weightings, wherein a highest-value weighting in the set of non-binary pulse weightings represents the a pulse of duration less than one half of a total duration of pixel illumination required within an image refresh period to achieve illumination of the pixel at a greatest of said plurality of brightness levels and to generate a sequence of outputs for storage in an image buffer associated with the digital display device, each output comprising, for a pulse of a duration defined according to a weighting in the set of pulse weightings, indications of those pixels to be illuminated with the pulse of said defined duration, wherein ones of the plurality of binary pulse weightings are alternately intermixed with ones of the plurality of non-binary pulse weightings; and means for controlling the digital display device to illuminate those pixels indicated by the contents of the image buffer.

11. The system according to claim 10, wherein the highest-value weighting in the plurality of non-binary pulse weightings represents a pulse of duration no more than one quarter of the total duration of pixel illumination required within an image refresh period to achieve illumination of the pixel at the greatest of said plurality of brightness levels.

12. The system according to claim 11, wherein the plurality of non-binary pulse weightings includes two or more non-binary pulse weightings having the same highest-value.

13. The system according to claim 10, wherein each of said plurality of brightness levels is defined in received image data by a binary value representing a sequence of pulses each of binary-weighted duration and the processor is arranged to convert brightness levels defined in received image data into brightness levels defined according to respective sequences of light pulses having relative durations defined by weightings selected from the set of the plurality of binary pulse weightings and the plurality of non-binary pulse weightings.

14. The system according to claim 13, wherein each of said plurality of brightness levels is defined in received image data by a binary value representing a sequence of pulses each of binary-weighted relative duration and the processor is arranged to convert a received binary value into a binary value representing a predetermined sequence of light pulses of relative durations defined by weightings selected from the set of the plurality of binary pulse weightings and the plurality of non-binary pulse weightings, and to use the results of the conversion to generate said sequence of outputs.

15. The system according to claim 14, wherein the received image data comprise brightness levels represented by 8-bit binary values in the range 0 to 255, each representing a sequence of pulses of binary weighted relative durations selected from the set of the plurality of binary pulse weightings and the plurality of non-binary pulse weightings 1, 2, 4, 8, 16, 32, 64 and 128, wherein the processor is arranged to convert a brightness level defined by a received 8-bit binary value into a binary value representing a predetermined sequence of light pulses of relative durations defined by weightings selected from the set of the plurality of binary pulse weightings and the plurality of non-binary pulse weightings 1, 2, 4, 8, 16, 32, 48, 48, 48 and 48, and to use the results of the conversion to generate said sequence of outputs.

16. The system according to claim 15, wherein the set of the plurality of binary pulse weightings and the plurality of non-binary pulse weightings further comprises a non-binary pulse weighting of 24.

17. The system according to claim 10, wherein said sequence of outputs represent pulses of higher weighting intermixed with pulses of lower weighting.

18. A head-mountable or helmet-mountable display system having a digital display device incorporating or associated with a display controller arranged to implement the method according to claim 1.

19. The head-mountable or helmet-mountable display system according to claim 10 having a digital display device arranged to illuminate pixels with light pulses of relative duration defined by weightings selected from the set of the plurality of binary pulse weightings and the plurality of non-binary pulse weightings.

20. The head-mountable or helmet-mountable display system according to claim 19, wherein the digital display device is arranged to illuminate pixels with light pulses of relative durations defined by weightings selected from the set of weightings 1, 2, 4, 8, 16, 32, 48, 48, 48, 48.

21. The head-mountable or helmet-mountable display system according to claim 19, wherein the digital display device is arranged to illuminate pixels with light pulses of relative durations defined by weightings selected from the set of weightings 1, 2, 4, 8, 16, 24, 32, 48, 48, 48, 48.

* * * * *